United States Patent [19]

Zorn et al.

[11] Patent Number: 4,477,714

[45] Date of Patent: Oct. 16, 1984

[54] METHOD OF LEAK PROOF ATTACHMENT OF A FLANGE-TYPE SHEET METAL ELEMENT IN THE BORE OF A VALVE TAPPET

[75] Inventors: Helmut Zorn; Karl Spiess; Wenzel Bina, all of Herzogenaurach, Fed. Rep. of Germany

[73] Assignee: INA Walzlager Schaeffler KG, Fed. Rep. of Germany

[21] Appl. No.: 459,107

[22] Filed: Jan. 19, 1983

[30] Foreign Application Priority Data

Feb. 2, 1982 [DE] Fed. Rep. of Germany ..... 3203439

[51] Int. Cl.[3] ..... B21J 1/06; H05B 1/00; B21D 53/00; B21K 29/00

[52] U.S. Cl. ..... 219/149; 29/156.7 B; 29/511; 29/520

[58] Field of Search ..... 219/50, 78.01, 149 R, 219/150 R; 29/520, 511, 509, 157 R, 156.7 B; 123/90.51, 90.52, 90.55, 90.56, 90.57

[56] References Cited

U.S. PATENT DOCUMENTS

| | | | |
|---|---|---|---|
| 174,821 | 3/1876 | Johnson | 29/511 |
| 1,590,749 | 6/1926 | Hulbert | 29/509 |
| 2,055,342 | 9/1936 | Schneider | 29/156.7 B |
| 2,113,895 | 4/1938 | Marande | 29/156.7 B X |
| 2,118,446 | 5/1938 | Schneider | 29/156.7 B |
| 2,127,982 | 8/1938 | Northup et al. | 29/511 |
| 2,237,121 | 4/1941 | Stine et al. | 219/149 |
| 2,308,968 | 1/1943 | Gregory | 219/149 |
| 3,007,603 | 11/1961 | Krehl | 29/511 |
| 3,039,798 | 6/1962 | Carlson et al. | 29/509 R |
| 3,151,501 | 10/1964 | Hichs | 29/156.7 B |
| 3,318,645 | 5/1967 | Sutowski | 29/511 |
| 3,699,637 | 10/1972 | Rosiek | 29/520 X |
| 4,134,200 | 1/1979 | Frigo | 29/511 |
| 4,379,961 | 4/1983 | Schmidt | 219/78.01 |
| 4,389,558 | 6/1983 | Schmidt | 219/78.01 |
| 4,418,264 | 11/1983 | Thorwarth | 219/78.01 |

FOREIGN PATENT DOCUMENTS

| | | | |
|---|---|---|---|
| 914915 | 1/1963 | United Kingdom | 29/511 |

*Primary Examiner*—Charlie T. Moon
*Assistant Examiner*—Ronald S. Wallace
*Attorney, Agent, or Firm*—Charles A. Muserlian

[57] ABSTRACT

A novel method of leak proof attachment of the outer edge of a flange-type sheet metal element in the bore of a steel cup-shaped valve tappet acting as a hydraulic play-compensating element for a combustion engine comprising (a) reducing the diameter of the bore of the valve tappet in two steps from the open end, the axial spacing of the two steps being greater than the thickness of the sheet metal element, (b) placing the outer edge of the sheet metal element on the second step and (c) simultaneously axially applying pressure on the first step with a die and heating by electric resistance with leads connected to the die and the hold-down ram and apparatus for the process and the product produced thereby.

3 Claims, 4 Drawing Figures

METHOD OF LEAK PROOF ATTACHMENT OF A FLANGE-TYPE SHEET METAL ELEMENT IN THE BORE OF A VALVE TAPPET

STATE OF THE ART

DE-OS No. 2,754,446 describes a method of such a leak proof attachment of a flange-type sheet metal element and the bore of a cup-shaped valve tappet by arranging therebetween an annular metallic element which is more easily deformable than the material of the valve tappet and then plastically deforming the annular element with a die so that it sealingly engages in a recess in the valve tappet bore and embraces the outer edge of the flange-type sheet metal element in a formlocking and sealing manner.

This known method, which leads to perfectly useful results, has the disadvantage that an additional element namely the ring of more easily deformable material, is required, and that moreover the recess in the bore of the valve tappet into which this ring must be fitted requires additional chip-removing machining, which must meet high precision requirements if a really leak proof seat is to be obtained. Another factor is that because of the different coefficients of thermal expansion of the valve tappet and flange type sheet metal element and of the annular element which may be made of aluminum, for example, there is danger that undesirable leaks may occur under certain temperature conditions.

OBJECTS OF THE INVENTION

It is an object of the invention to propose a method by which a satisfactory and permanently leak proof attachment of the flange type sheet metal element in the bore of the valve tappet becomes possible without requiring an additional structural element and the product produced thereby and the apparatus for the process.

These and other objects and advantages of the invention will become obvious from the following detailed description.

THE INVENTION

The novel method of the invention of leak proof attachment of the outer edge of a flange-type sheet metal element in the bore of a steel cup-shaped valve tappet acting as a hydraulic play-compensating element for a combustion engine comprises (a) reducing the diameter of the bore of the valve tappet in two steps from the open end, the axial spacing of the two steps being greater than the thickness of the sheet metal element, (b) placing the outer edge of the sheet metal element on the second step and (c) simultaneously axially applying pressure on the first step with a die and heating by electric resistance with leads connected to the die and the hold-down ram.

By heating in the region of the valve tappet bore in which the die engages the tappet material becomes plastically deformable there whereby it is molded around the edge of the sheet metal element so that the latter is embedded absolutely leak proof. Because of the resistance heating employed during the shaping process, it is possible to carry out the shaping even when the part is case-hardened without requiring a previous tempering proces or the like. To make sure that the heating remains limited to a small area and hence has no adverse effect on the contiguous area of the valve tappet, particularly its outer jacket surface, the electric current can, in further development of the invention, be supplied for only an extremely short time (pulse feed), especially for a period of only 0.02 to 0.8 seconds.

The apparatus for the practice of the method of the may be designed so that the die is a hollow-cylindrical part, into the bore of which a hold-down ram is guided for longitudinal displacement under electric insulation and is braced against the die by a spring with one current lead being brought to the die and the other to the hold-down ram. With the use of this device a limitation of the heating to the area to be deformed is additionally achieved in that the current flows only between the die and the hold-down ram across the parts coming in contact with these two rams.

Referring now to the drawings.

Figure 1:
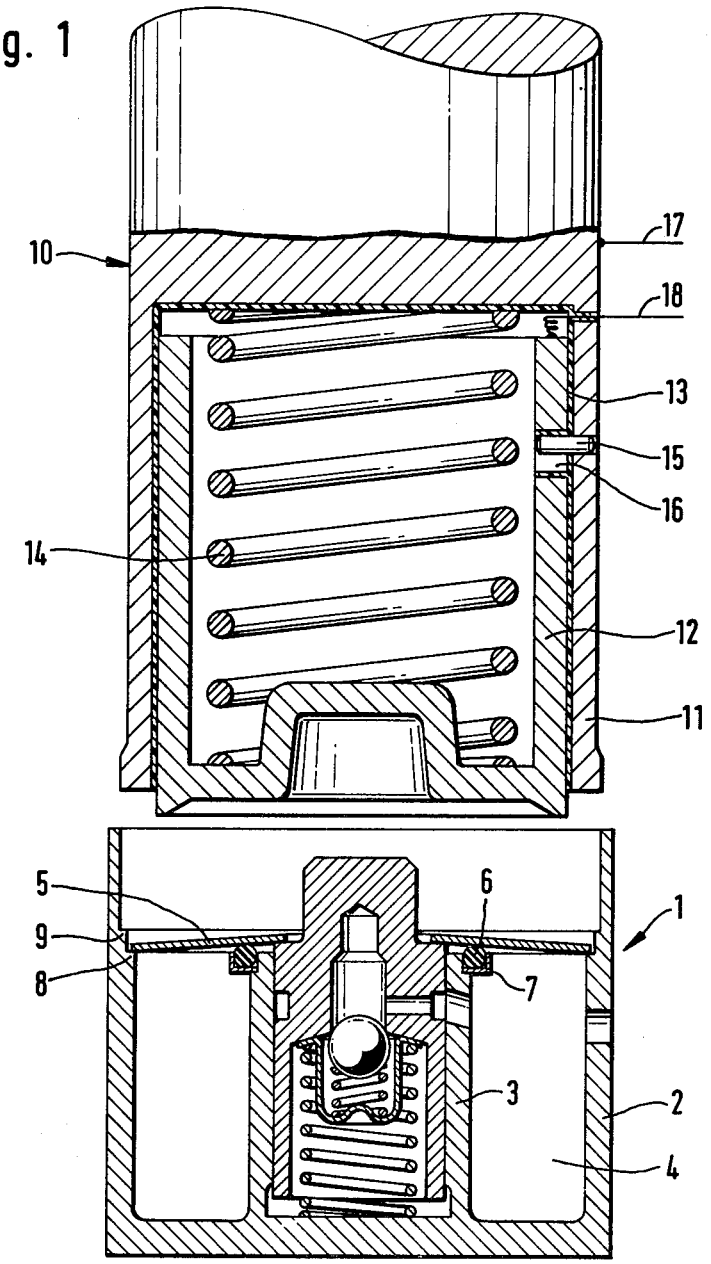
FIG. 1 is a longitudinal cross-sectional view through a valve tappet and die of the invention.

The valve tappet shown in FIG. 1 consists of a beaker-shaped housing 1 comprising an outer wall 2 and concentric thereto a cylindrical inner element 3. The concentric elements 2 and 3 define the oil supply chamber 4 and at the open side of the beaker-shaped housing 1, this oil supply chamber 4 is closed by the flange type sheet metal element 5, which is supported on the seal ring 6 disposed on the angular ring 7 supported on the cylindrical inner part 3, and on the other end rests on the second step 8 of the doubly stepped bore of the outer wall 2. The axial distance between this second step 8 and the preceding first step 9 is greater than the thickness of the sheet metal element 5.

Ram 10 shown in FIG. 1 has at is lower end a hollow-cylindrical die 11 which receives in its bore hold-down ram 12 guided for longitudinal displacement under electrical insulation 13. Both rams 11 and 12 are displaced axially against one another by a spring 14 by such a distance as pin 15 will permit, which is fastened in a bore of die 11 and engages a longitudinal slot 16 of the hold-down ram 12. The electric current required for resistance heating is supplied by the line 17 connected with die 11 and by line 18 connected with the hold-down ram 12.

Figure 2:
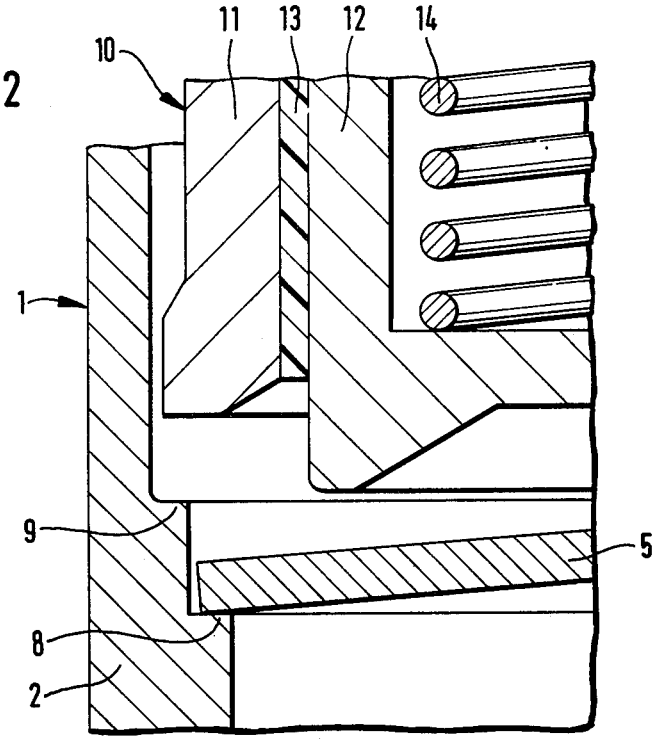
FIGS. 2 to 4 are partial longitudinal cross-sectional views similar to FIG. 1 in various successive process phases.
Figure 3:
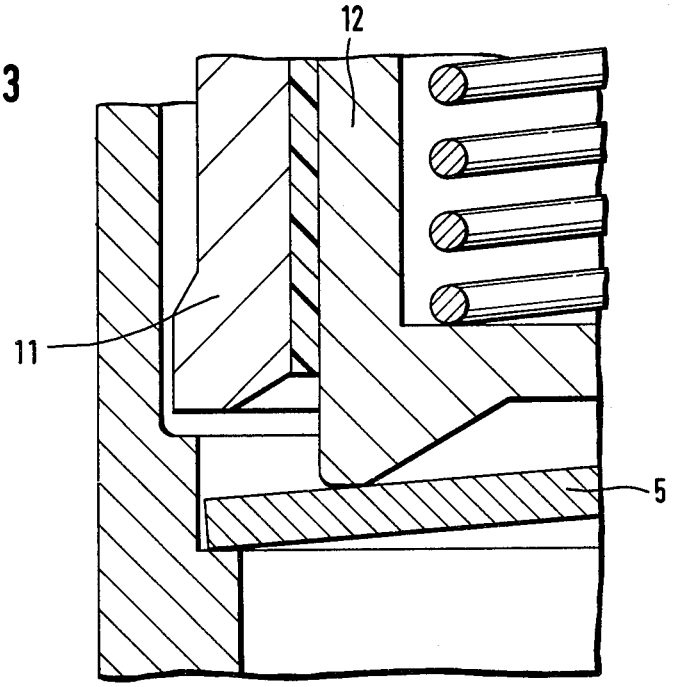
Figure 4:
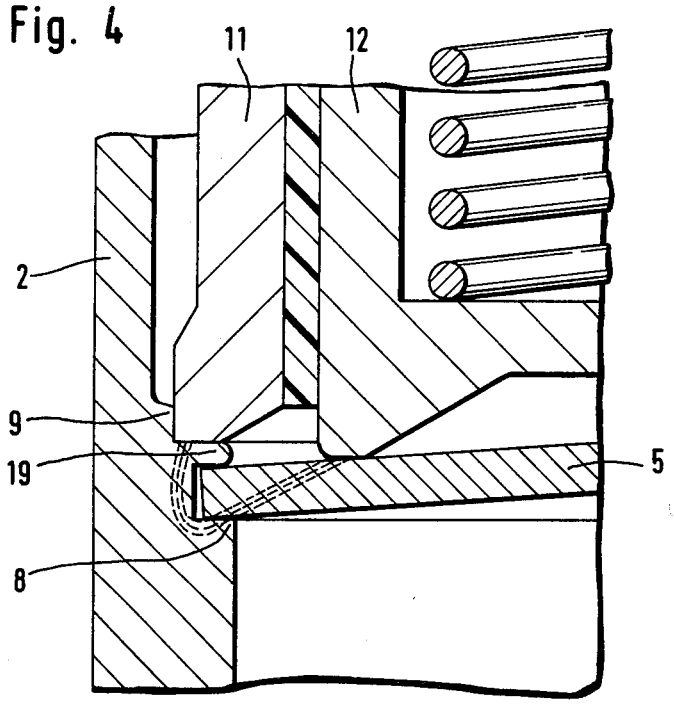

FIG. 2 shows in detail the state in which ram 10 is introduced into the bore of the beaker-shaped housing 1 before it is in contact with the elements of the valve tappet. In the phase illustrated in FIG. 3, hold-down ram 12 now has contact with the flange type sheet metal element 5 while die 11 is not yet in contact with the valve tappet. FIG. 4 lastly shows the state in which die 11 has, after supply of the current required for the resistant heating, plastically deformed the material in the area of the first step 9 so that it places itself around the outer edge of the flange type sheet metal element 5 as a torus 19 thus enclosing it in a leak proof manner. The current flow has been entered in this figure in broken lines, indicating that when this device is used, it need not be feared that the hardness layer at the outer surface of the outer wall 2 will be adversely affected.

Various modifications of the apparatus, method and products of the invention may be made without departing from the spirit or scope thereof and it is to be understood that the invention is intended to be limited only as defined in the appended claims.

What we claim is:

1. A method of leak proof attachment of the outer edge of a flange-type sheet metal element in the bore of a steel cup-shaped valve tappet acting as a hydraulic play-compensating element for a combustion engine comprising (a) reducing the diameter of the bore of the valve tappet in two stepped portions from the open end, the axial spacing of the two stepped portions being greater than the thickness of the sheet metal element, (b) placing the outer edge of the sheet metal element on the innermost stepped portion and simultaneously axially applying pressure on the outermost stepped portion with an outer die and on the sheet metal element with a hold-down ram with said die being electrically insulated from said ram, and (d) heating by electric resistance with leads connected to the die and the hold-down ram causing the pressure applied by said outer die to plastically deform inwardly the outermost stepped portion thereby capturing the sheet metal element between said inwardly deformed outermost stepped portion and said innermost stepped portion.

2. The method of claim 1 wherein the electric current is supplied in extremely brief pulses.

3. The method of claim 2 wherein the pulses are a period of 0.02 to 0.8 seconds.

* * * * *